US010968861B2

(12) United States Patent
Kageyama

(10) Patent No.: US 10,968,861 B2
(45) Date of Patent: Apr. 6, 2021

(54) CYLINDER HEAD

(71) Applicant: Komatsu Ltd., Tokyo (JP)

(72) Inventor: Yuuki Kageyama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 16/318,866

(22) PCT Filed: Oct. 29, 2018

(86) PCT No.: PCT/JP2018/040111
§ 371 (c)(1),
(2) Date: Jan. 18, 2019

(87) PCT Pub. No.: WO2019/066089
PCT Pub. Date: Apr. 4, 2019

(65) Prior Publication Data

US 2020/0132015 A1 Apr. 30, 2020

(51) Int. Cl.

| | |
|---|---|
| ***F02F 1/24*** | (2006.01) |
| ***F01M 9/10*** | (2006.01) |
| ***F02F 1/42*** | (2006.01) |
| ***F02B 31/04*** | (2006.01) |
| ***F01L 1/18*** | (2006.01) |
| ***F01P 3/02*** | (2006.01) |

(52) U.S. Cl.
CPC ..... *F02F 1/4285* (2013.01); *F01L 1/18* (2013.01); *F01M 9/101* (2013.01); *F01P 3/02* (2013.01); *F02B 31/04* (2013.01); *F02F 1/242* (2013.01); *F02F 2001/244* (2013.01)

(58) Field of Classification Search
CPC .... F02F 1/4285; F02F 2001/244; F02F 1/242; F01M 9/101; F01L 1/18; F01P 3/02; F02B 31/04
See application file for complete search history.

(56) References Cited

U.S. PATENT DOCUMENTS 3,174,467 A * 3/1965 Sampietro ..... F01L 1/38 123/273
4,522,169 A * 6/1985 Arai ..... F01L 1/2405 123/198 F (Continued)

FOREIGN PATENT DOCUMENTS

CN 1204004 A 1/1999
CN 1253609 A 5/2000

(Continued)

*Primary Examiner* — Syed O Hasan
(74) *Attorney, Agent, or Firm* — Locke Lord LLP

(57) ABSTRACT

The cylinder head includes an intake port communicating with a cylinder of a cylinder block, a cylinder head main body having an exhaust port communicating with the cylinder, and a rocker housing integrally formed on the cylinder head main body and an inner side of which is defined as a valve-system accommodating space. The rocker housing includes a lateral wall having a lateral wall main body and a base end portion which extends along a lower end of the lateral wall main body, connects the lateral wall main body to the cylinder head main body, and has a thickness thicker than that of the lateral wall body. A flow path which extends in an extending direction of the base end portion and through which a fluid flow is formed in the base end portion.

3 Claims, 5 Drawing Sheets

(56) References Cited

U.S. PATENT DOCUMENTS

| | | | | |
|---|---|---|---|---|
| 6,098,595 | A * | 8/2000 | Peters | F02F 1/108 123/308 |
| 6,155,228 | A | 12/2000 | Breitenberger | |
| 6,178,936 | B1 | 1/2001 | Kouchi et al. | |
| 6,338,334 | B1 * | 1/2002 | Ando | F02M 33/04 123/456 |
| 6,998,334 | B2 * | 2/2006 | Farnworth | H01L 23/3157 438/612 |
| 2009/0078240 | A1 * | 3/2009 | Diggs | F02B 37/007 123/559.1 |
| 2010/0242914 | A1 * | 9/2010 | Negoro | F02M 35/112 123/445 |
| 2015/0136066 | A1 * | 5/2015 | Hikita | F01M 9/10 123/196 R |
| 2016/0341099 | A1 | 11/2016 | Utsumi | |
| 2017/0335791 | A1 * | 11/2017 | Schick | F02F 1/24 |

FOREIGN PATENT DOCUMENTS

| | | | |
|---|---|---|---|
| CN | 203441616 | U | 2/2014 |
| EP | 0664392 | A1 | 7/1995 |
| JP | 04-006564 | U | 1/1992 |
| JP | 06-167260 | A | 6/1994 |
| JP | 07-071311 | A | 3/1995 |
| JP | 09-250321 | A | 9/1997 |
| JP | 11-280596 | A | 10/1999 |
| JP | 2016-217244 | A | 12/2016 |

* cited by examiner

CYLINDER HEAD

TECHNICAL FIELD

The present invention relates to a cylinder head.

BACKGROUND TECHNOLOGY

In Patent Document 1, an engine in which a rocker housing (rocker arm case) is integrally formed with a cylinder head is disclosed.

PRIOR ART DOCUMENT

Patent Document

[Patent Document 1] Japanese Unexamined Patent Application Publication No. H09-250321.

SUMMARY OF THE INVENTION

Problems to be Solved by the Invention

It is desired to increase the rigidity and reduce the size of the cylinder head in which the rocker housing is integrated.

The present invention is provided in view of such problem and the purpose of which is to provide a cylinder head which is improved in rigidity and is reduced in size.

Means for Solving the Problem

A cylinder head according to a first aspect of a present invention includes: a cylinder head main body having an intake port communicating with a cylinder of a cylinder block and an exhaust port communicating with the cylinder; and a rocker housing integrally formed on the cylinder head main body and an inner side of which is a valve-system accommodating space. The rocker housing includes a lateral wall having a lateral wall main body and a base end portion that extends along an lower end of the lateral wall main body, connects the lateral wall main body to the cylinder head main body, and has a thickness thicker than that of the lateral wall main body, and wherein a flow path extending in an extending direction of the base end portion and through which a fluid flows is formed in the base end portion.

Effect of Invention

According to the present invention, it is possible to increase the rigidity of the cylinder head and to reduce the size of the cylinder head.

MODE FOR CARRYING OUT THE INVENTION

Figure 1:
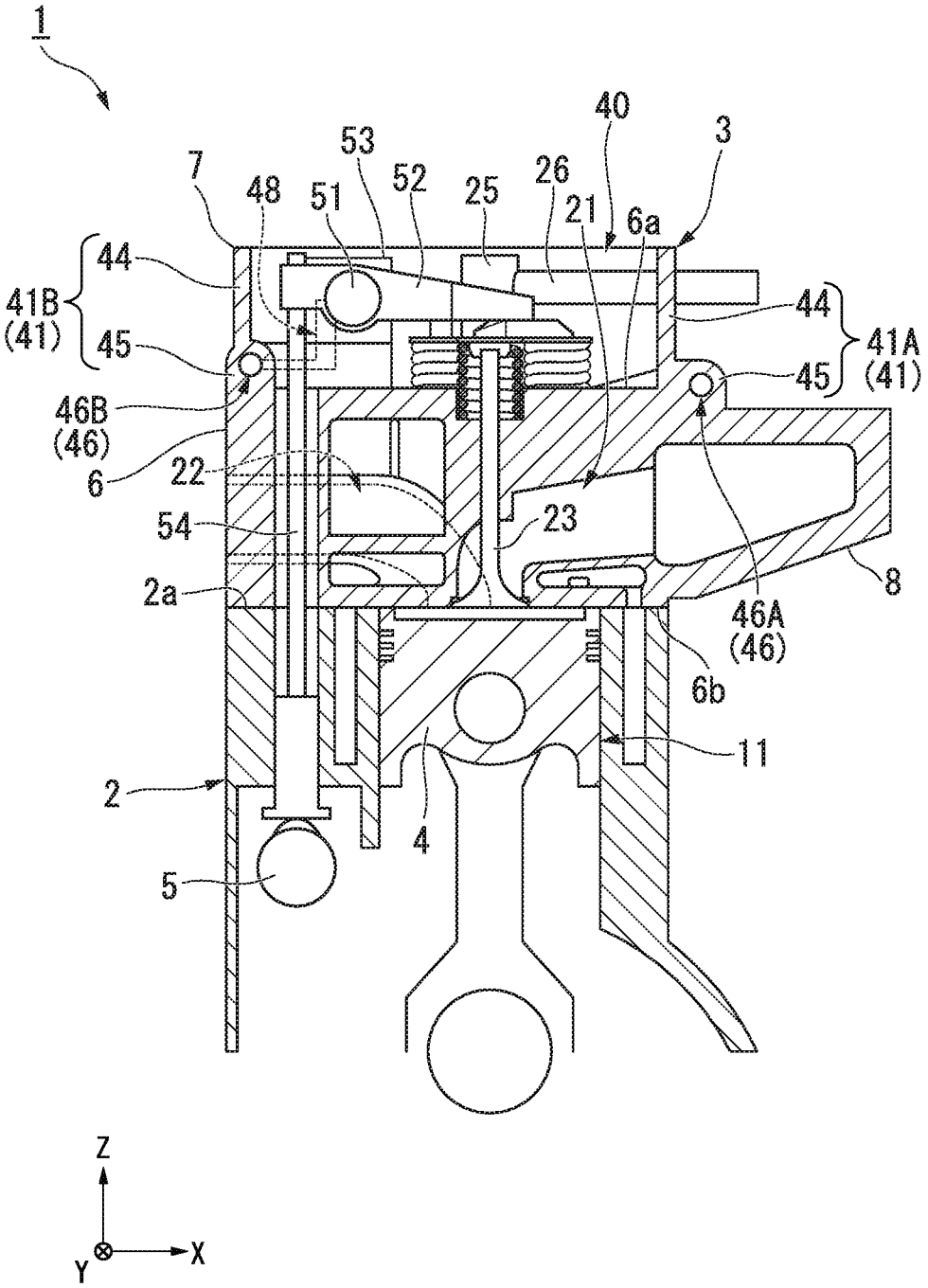
FIG. 1 is a cross-sectional view showing an engine including a cylinder head according to an embodiment of the present invention.

Hereinafter, the embodiment of the present invention will be described in detail with reference to FIGS. 1 to 5. As shown in FIG. 1, a cylinder head 3 according to the present embodiment constitutes an engine 1 together with a cylinder block 2. The engine 1 of the present embodiment is a diesel-engine.

In FIGS. 1 to 5, a direction in which the cylinder block 2 and the cylinder head 3 are arranged is defined as a Z-axis direction. Further, a first orthogonal direction orthogonal to the Z-axis direction is defined as a Y-axis direction. Further, a second orthogonal direction orthogonal to the Z-axis direction and the Y-axis direction is defined as an X-axis direction.

<Cylinder Block>

Figure 2:
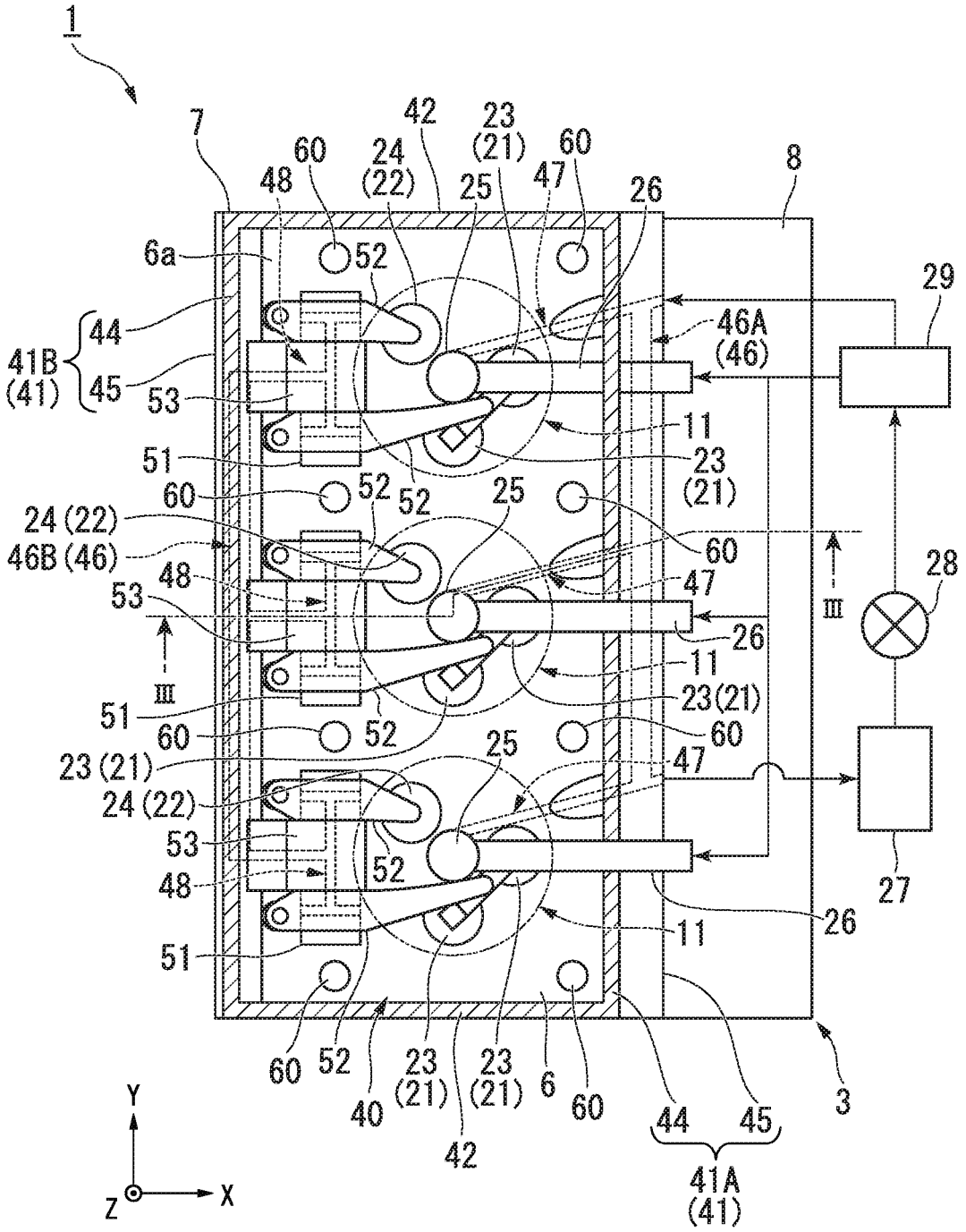
FIG. 2 is a top view showing the engine of FIG. 1 viewed from above.

As shown in FIG. 1, a cylinder 11 is formed in the cylinder block 2. The cylinder 11 has a space in which a piston 4 is disposed. The cylinder 11 is opened into an upper surface 2*a* of the cylinder block 2. The piston 4 reciprocates in a vertical direction (Z-axis direction) by receiving a pressure of combustion gas that has been combusted in the cylinder 11. As shown in FIG. 2, the cylinder block 2 of the present embodiment includes a plurality of (three in the illustrated example) cylinders 11. The plurality of cylinders 11 are aligned in a line in the first orthogonal direction (Y-axis direction) orthogonal to the vertical direction. In the following description, the first orthogonal direction in which the plurality of cylinders 11 are arranged will be referred to as a cylinder arranged direction.

As shown in FIG. 1, a cam shaft 5 for driving a rocker arm 52, which will be described later, is disposed in the cylinder block 2. The cam shaft 5 extends in the cylinder arranged direction. The cam shaft 5 rotates in response to the reciprocating movement of the piston 4.

<Cylinder Head>

The cylinder head 3 is disposed on the upper surface 2*a* of the cylinder block 2 so as to be mounted thereon. The cylinder head 3 includes a cylinder head main body 6 and a rocker housing 7. Further, the cylinder head 3 further includes an intake manifold 8.

<Cylinder Head Main Body>

The cylinder head main body 6 has an intake port 21 and an exhaust port 22. Each of the intake port 21 and the exhaust port 22 communicates with the cylinder 11 of the cylinder block 2.

A first end of the intake port 21 in a longitudinal direction is opened into a lower surface 6*b* of the cylinder head main body 6 that is opposed to the upper surface 2*a* of the cylinder block 2. The first end of the intake port 21 is connected to the cylinder 11. A second end of the intake port 21 is opened into a lateral portion of the cylinder head main body 6, which is directed toward one side (X-axis positive direction side) of the second orthogonal direction orthogonal to the vertical direction and the cylinder arranged direction. The second end of the intake port 21 is connected to the intake manifold 8, which will be described later. The intake port 21 extends upward from the cylinder 11 side and then extend so as to bend toward one side of the second orthogonal direction. In other words, the intake port 21 is formed so as to intake air from the intake side of the cylinder head main body 6, which is one side of the second orthogonal direction.

A first end of the exhaust port 22 in the longitudinal direction is opened into the lower surface 6*b* of the cylinder head main body 6, similar to the intake port 21. The first end of the exhaust port 22 is connected to the cylinder 11. A second end of the exhaust port 22 is opened into a lateral portion of the cylinder head main body 6, which is directed toward the other side of the second orthogonal direction (X-axis negative direction side). The exhaust port 22 extends upward from the cylinder 11 side and then extends so as to bend toward the other side of the second orthogonal direction. In other words, the exhaust port 22 is formed so as to exhaust air to an exhaust side of the cylinder head main body 6, which is the other side of the second orthogonal direction. The intake port 21 and the exhaust port 22 are provided at positions closer to the lower-end portion side (the cylinder block 2 side) of the cylinder head main body 6.

In this embodiment, the intake port 21 and the exhaust port 22 communicate with each of the plurality of cylinders 11. In other words, the intake port 21 and the exhaust port 22 are formed so as to correspond to the respective cylinders 11. In this embodiment, as shown in FIG. 2, two intake ports 21 and one exhaust port 22 are formed for one cylinder 11. Each of the plurality of intake ports 21 and the plurality of exhaust ports 22 are arranged in the cylinder arranged direction.

As shown in FIG. 1 and FIG. 2, in the cylinder head main body 6, an intake valve 23 for opening and closing the first end of each intake port 21 is provided so as to be movable in the vertical direction. Part of the intake valve 23 protrudes from the upper surface 6*a* of the cylinder head main body 6. Similar to the intake valve 23, the cylinder head main body 6 is provided with an exhaust valve 24 for opening and closing the first end of each exhaust port 22. The constitution and the arrangement of the exhaust valve 24 are similar to those of the intake valve 23.

Figure 3:
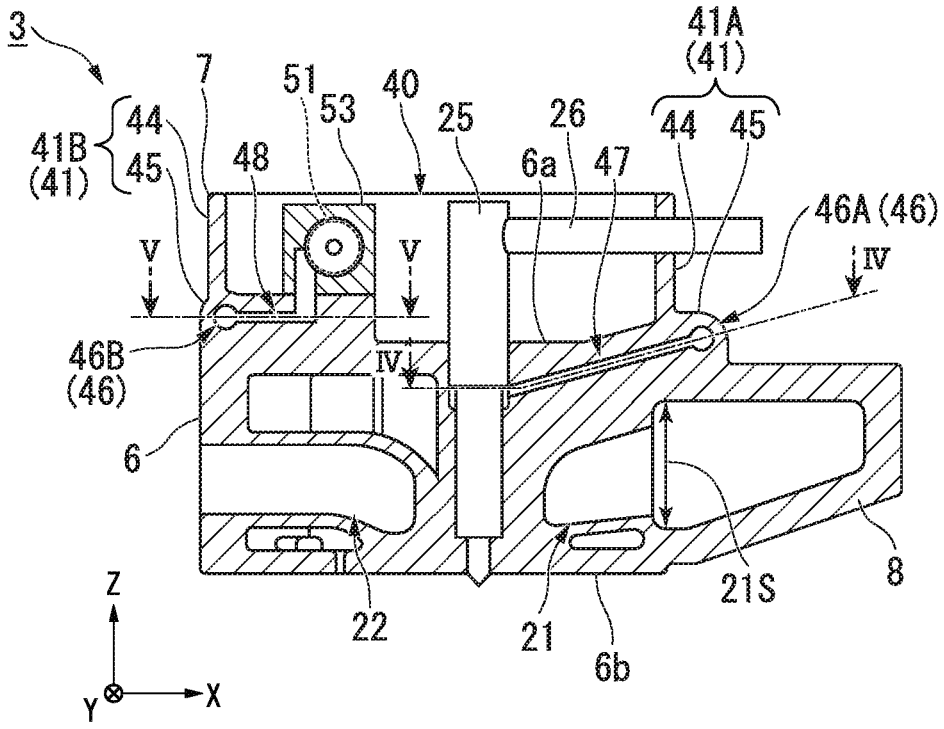
FIG. 3 is a cross-sectional view taken along a line III-III of FIG. 2.
Figure 4:
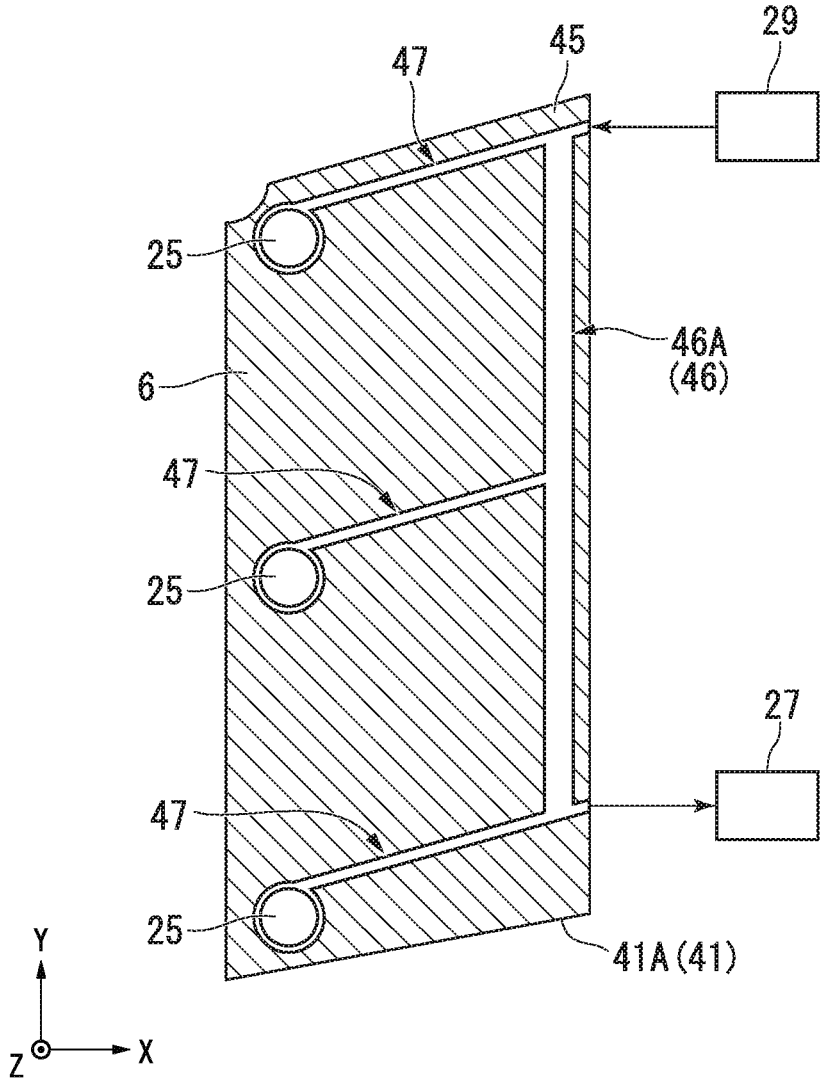
FIG. 4 is a cross-sectional view taken along a line IV-IV of FIG. 3.
Figure 5:
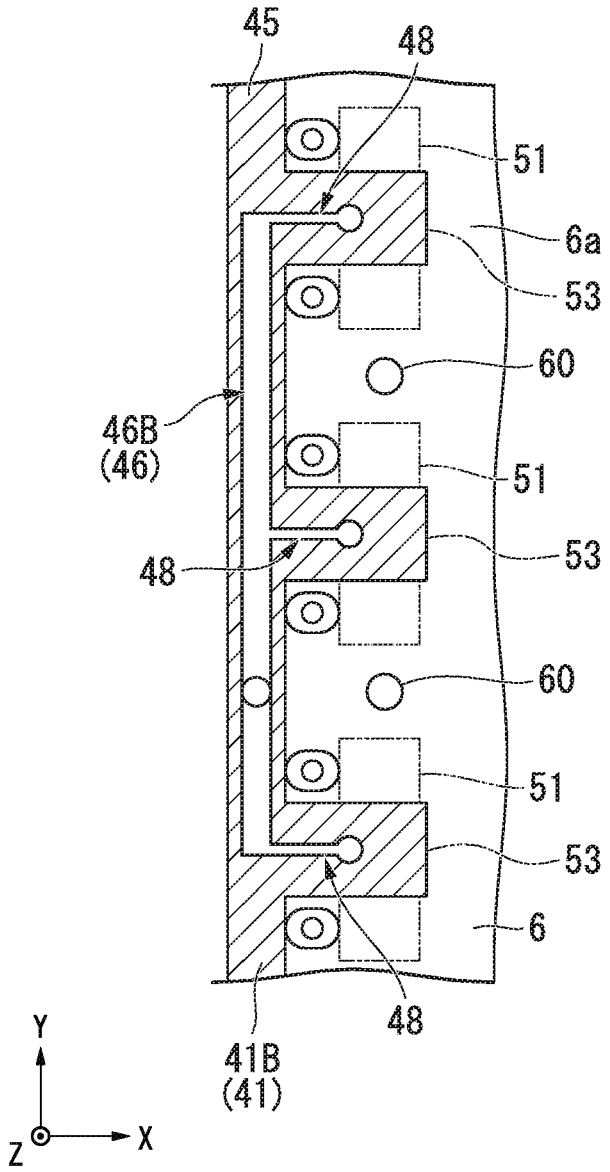
FIG. 5 is a cross-sectional view taken along a line V-V of FIG. 3.

As shown in FIG. 2 and FIG. 3, the cylinder head main body 6 is provided with a fuel injecting device 25 (fuel injector) for injecting fuel into the cylinder 11. The fuel injector 25 passes through the cylinder head main body 6 in the vertical direction. One fuel injector 25 is provided for each of the plurality of cylinders 11. In other words, in the present embodiment, a plurality of fuel injectors 25 are arranged in the cylinder arranged direction.

Each of the fuel injectors 25 is positioned so as to correspond to the center of each cylinder 11 in a plan view (FIG. 2) as viewed the cylinder head main body 6 from above. Around the fuel injector 25, the first ends of the intake port 21 and the exhaust port 22 both of which are opened into the same cylinder 11, and the intake valve 23 and the exhaust valve 24 which open and close the first ends thereof are located.

A fuel supply pipe 26 extending toward one side (intake side) in the second orthogonal direction is connected to an upper surface portion of each fuel injector 25 protruding from an upper end 6*a* of the cylinder head main body 6. Each of the fuel supply pipes 26 passes through an intake-side lateral wall 41A of the rocker housing 7, which will be described later. As shown in FIG. 2, a plurality of fuel supply pipes 26 are connected to a common rail 29. The common rail 29 is a pipe conduit that holds the fuel at a predetermined pressure (high pressure). The common rail 29 may be fixed, for example, to the cylinder head 3. The fuel flows from a fuel tank 27 to a fuel pump 28 and the common rail 29 in this order, then flows through each of the fuel supply pipes 26 and each of the fuel injectors 25 in this order, and is injected into the respective cylinders 11.

<Rocker Housing>

As shown in FIGS. 1 to 3, the rocker housing 7 is integrally formed on the cylinder head main body 6. An inner side of the rocker housing 7 is a valve-system accommodating space 40.

As shown in FIG. 2, the rocker housing 7 has a lateral wall 41 and an end wall 42. Each of the lateral wall 41 and the end wall 42 extends upward (in the Z-axis positive direction) of the cylinder head main body 6 at a peripheral edge of the upper surface 6*a* of the cylinder head main body 6. The lateral wall 41 extends in the cylinder arranged direction (Y-axis direction) at the both ends of the cylinder head main body 6 in the second orthogonal direction (X-axis direction). On the other hand, the end wall 42 extends in the second orthogonal direction at the both ends of the cylinder head main body 6 in the cylinder arranged direction. A space surrounded by the pair of lateral walls 41 and the pair of end walls 42 is the valve-system accommodating space 40 described above. A bottom surface of the valve-system accommodating space 40 is constituted by the upper surface 6*a* of the cylinder head main body 6.

As shown in FIG. 1 and FIG. 2, a rocker shaft 51 and a rocker arm 52 for driving the intake valve 23 and the exhaust valve 24 described above as valve-system parts are accommodated in the valve-system accommodating space 40.

As shown in FIGS. 1 to 3, the rocker shaft 51 is integrally formed with a rocker bracket 53 fixed to the bottom surface of the valve-system accommodating space 40. The rocker shaft 51 is located above the bottom surface of the valve-system accommodating space 40 at a distance therefrom by a rocker bracket 53. The rocker shaft 51 extends in the cylinder arranged direction. The rocker shaft 51 and the rocker bracket 53 are disposed in a region of the valve-system accommodating space 40 on an exhaust side (an X-axis negative direction side) of the cylinder head main body 6.

As shown in FIG. 1 and FIG. 2, the rocker arm 52 is swingably mounted on the rocker shaft 51. The rocker arm 52 is provided for each of the intake valve 23 and the exhaust valve 24 corresponding to each of the cylinders 11. The plurality of rocker arms 52 are arranged in the cylinder arranged direction. Along with the rotation of the camshaft 5, each rocker arm 52 swings around the rocker shaft 51 by a movement in the vertical direction of the push rods 54 (FIG. 1) passing through in the vertical direction of the cylinder head main body 6. As a result, it is possible to drive the intake valve 23 and the exhaust valve 24.

In the present embodiment, a plurality of rocker shafts 51 are provided separately from each other. The plurality of rocker shafts 51 are arranged at a distance from each other in the cylinder arranged direction. The rocker shafts 51 are provided so as to correspond to the respective cylinders 11. In other words, the number of the rocker shafts 51 is the same as that of the cylinders 11. A rocker arm 52 corresponding to each of the cylinders 11 is mounted on the same rocker shaft 51. Further, the rocker bracket 53 is provided for each of the plurality of rocker shafts 51.

Each lateral wall 41 of the rocker housing 7 has a lateral wall main body 44 and a base end portion 45. The base end portion 45 of each lateral wall 41 extends along the lower end of the lateral wall main body 44 in the cylinder arranged direction, and is a portion connecting the lateral wall main body 44 to the cylinder head main body 6. The thickness of the base end portion 45 of each lateral wall 41 is thicker than the thickness of the lateral wall main body 44. A flow path 46 extending in the extending direction (Y-axis direction) of the base end portion 45 is formed in the base end portion 45 of each of the lateral walls 41. In other words, the flow path 46 extends in the cylinder arranged direction.

<Fuel Return Flow Path>

As shown in FIGS. 1 to 4, a fuel return flow path 46A is formed as the aforementioned flow path 46 in the base end portion 45 of the intake-side lateral wall 41A disposed on the intake side (X-axis positive direction side) of the cylinder head main body 6 among a pair of lateral walls 41. A fuel (fluid) returned from the plurality of fuel injectors 25 flows through the fluid-return flow path 46A. As shown in FIGS.

2 to 4, a connecting flow path 47 extending from each of the plurality of fuel injectors 25 in an inside portion of the cylinder head main body 6 is connected to the fuel return flow path 46A.

A first end of each connecting flow path 47 in a longitudinal direction is connected to a fuel return port (not shown) formed in an intermediate portion of each fuel injector 25 in the longitudinal direction. On the other hand, a second end of each connecting flow path 47 is connected to the fuel return flow path 46A. Here, the fuel return port is located lower (on the Z-axis negative direction side) than the fuel return flow path 46A. Therefore, each of the connecting flow paths 47 extends so as to incline upward from each of the fuel injectors 25 toward the intake side of the cylinder head main body 6. The plurality of connecting flow paths 47 are arranged at a distance with each other in a longitudinal direction of the fuel return flow path 46A.

A first end of the fuel return flow path 46A in the longitudinal direction (Y-axis direction) is connected to the fuel tank 27. Thus, the surplus fuel of the fuel supplied from the common rail 29 to each of the fuel injectors 25 returns to the fuel tank 27 via each connecting flow path 47 and each fuel return flow path 46A.

A second end of the fuel return flow path 46A is connected to the common rail 29. A valve (not shown) for opening and closing a line connecting the common rail 29 and the fuel return flow path 46A is provided between the common rail 29 and the fuel return flow path 46A. The valve opens when the pressure in the common rail 29 becomes excessively high and when the engine 1 is stopped. As a result, the fuel in the common rail 29 flows out to the fuel return flow path 46A, so that the pressure in the common rail 29 can be reduced. The fuel flowing out from an inside of the common rail 29 into the fuel return flow path 46A returns to the fuel tank 27 in the same manner as described above.

<Lubricating Oil Flow Path>

As shown in FIGS. 1 to 3, and 5, a lubricating oil flow path 46B is formed as the aforementioned flow path 46 in a base end portion 45 of an exhaust-side lateral wall 41B disposed on an exhaust side (X-axis negative direction side) of the cylinder head main body 6 among a pair of lateral walls 41. Lubricating oil (fluid) supplied to each sliding portion between the rocker shaft 51 and the rocker arm 52, which are a valve-system component, flows through the lubricating oil flow path 46B. A supply flow path 48 (indicated by a broken line in FIG. 1 and FIG. 2) extending from the lubricating oil flow path 46B to each sliding portion between the rocker shaft 51 and the rocker 52 is connected to the lubricating oil flow path 46B. In this embodiment, since a plurality of rocker shafts 51 are provided separately from each other, a plurality of supply flow paths 48 are connected to the lubricating oil flow path 46B. The plurality of supply flow paths 48 are arranged at a distance from each other in a longitudinal direction of the lubricating oil flow path 46B.

Each supply flow path 48 extends toward the intake side (X-axis positive direction side) of the cylinder head main body 6 at the inside portion of the cylinder head main body 6 so as to be directed from the lubricating oil flow path 46B toward the rocker bracket 53, and then extends so as to bend upward so as to enter into the rocker bracket 53 from the cylinder head main body 6. Further, each of the supply flow path 48 passes through the inside portions of the rocker bracket 53 and the rocker shaft 51 and opens into the outer peripheral surface of the rocker shaft 51 where the rocker arm 52 slides. As a result, as shown in FIG. 3, the lubricating oil can be supplied to the sliding portion between the rocker shaft 51 and the rocker arm 52.

The supply route of the lubricating oil to the lubricating oil flow path 46B may be arbitrary. The lubricating oil may be supplied, for example, from the cylinder block 2 side to the lubricating oil flow path 46B.

<Intake Manifold>

As shown in FIGS. 1 to 3, the intake manifold 8 is integrally formed on an intake side (X-axis positive direction side) of the cylinder head main body 6. The intake manifold 8 extends in the cylinder arranged direction so as to be connected to each of the intake ports 21.

Above the internal space of the intake manifold 8 connected to each intake port 21, the aforementioned fuel return flow path 46A is located. For this reason, as shown in FIG. 3, the connecting flow path 47 connecting the fuel return flow path 46A and the fuel injector 25 extends while inclining from the fuel injector 25 toward the intake side so as to pass between the valve-system accommodating space 40 and the internal space of the intake port 21 and the intake manifold 8 communicating with the intake port 21, in the inside portion of the cylinder head main body 6.

The cylinder head 3 of the present embodiment constituted as described above is fixed to the cylinder block 2 by a fixing bolt (not shown). As shown in FIG. 2, the cylinder head main body 6 has a plurality of bolt holes 60 which passes through in vertical direction of the cylinder head main body 6 and through which the fixing bolt is inserted. Each of the bolt holes 60 opens into a region surrounded by the rocker housing 7 of the upper surface 6*a* of the cylinder head main body 6. Each bolt hole 60 is formed at a position corresponding to a periphery of each of the cylinders 11. In the illustrated example, four bolt holes 60 are arranged in a peripheral direction of each of the cylinders 11. Part of the bolt holes 60 is located in a region between two adjacent rocker shafts 51 in the upper surface 6*a* of the cylinder head main body 6.

<Operation and Effects>

As described above, according to the cylinder head 3 of the present embodiment and the engine 1 provided with the same, the thickness of the base end portion 45 of the lateral wall 41 of the rocker housing 7 is thicker than that of the lateral wall main body 44.

Therefore, even if the thickness of the lateral wall main body 44 is thin, the rigidity of the lateral wall 41 of the rocker housing 7 can be improved. Further, since the lateral wall main body 44 can be formed thin, it is possible to reduce the weight of the cylinder head 3. Hereinafter, this point will be described.

By simply integrally molding the lateral wall 41 of the rocker housing 7 into the cylinder head main body 6, the stress tends to be concentrated on the base end portion 45 of the lateral wall 41. Therefore, when the entire lateral wall 41 is thin, it is liable to break in the base end portion 45 of the lateral wall 41. However, when the entire lateral wall 41 is formed thick, the stress concentration on the base end portion 45 of the lateral wall 41 can be suppressed, but the weight of the entire cylinder head 3 becomes heavy. Therefore, in the cylinder head 3 of the present embodiment, the base end portion 45 of the lateral wall 41 is formed thicker than that of the lateral wall main body 44. Therefore, it is possible to suppress the concentration of stress on the base end portion 45 of the lateral wall 41 and to reduce the weight of the entire cylinder head 3.

Further, according to the cylinder head 3 and the engine 1 of the present embodiment, the flow path 46 through which the fuel and the lubricating oil flows is formed in the base end portion 45 of the lateral wall 41 having a large thickness. Thus, as compared with a case where the flow path 46 is formed in another portion (e.g., an inside portion of the cylinder head main body 6), it is possible to reduce the size of the cylinder head main body 6. Further, as described above, since the thickness of the sidewall body 44 can be reduced, it is also possible to reduce the size of the rocker housing 7. Accordingly, it is possible to reduce the size of the cylinder head 3.

In addition, according to the cylinder head 3 and the engine 1 of the present embodiment, the fuel return flow path 46A and the lubricating oil flow path 46B formed in the lateral wall 41 of the rocker housing 7 and the base end portion 45 of the lateral wall 41 extend in the cylinder arranged direction. In other words, by forming thickly the base end portion 45 of the lateral wall 41 of the rocker housing 7, which is formed longer than the end wall 42 of the rocker housing 7, it is possible to enhance the rigidity of the lateral wall 41 extending in the cylinder arranged direction.

Further, by arranging a plurality of fuel injectors 25 in the cylinder arranged direction (the extending direction of the fuel return flow path 46A), it is possible to equalize the distance from the fuel return flow path 46A to each of the fuel injectors 25. Thus, part of the plurality of connecting flow paths 47 connecting the fuel return flow path 46A and the plurality of fuel injectors 25 is not lengthened, and all of the connecting flow paths 47 can be formed to be shorter in length than the connecting flow path. Similarly, by arranging the plurality of valve-system components in the cylinder arranged direction (extending direction of the lubricating oil flow path 46B), the distance from the lubricating oil flow path 46B to each of the valve-system components can be equalized. Thus, part of the plurality of supply flow path 48 extending from the lubricating oil flow path 46B to the plurality of valve-system components is not lengthened, and all of the supply flow paths 48 can be formed to be short.

Further, according to the cylinder head 3 and the engine 1 of the present embodiment, the connecting flow path 47 connecting the fuel return flow path 46A and the fuel injector 25 extends while inclining upward from the fuel injector 25 toward the intake side, so as to pass between the intake port 21 and the internal space of the intake manifold 8 communicating with the intake port 21. Therefore, it is possible to enlarge the opening of the intake port 21 which is located below the connecting flow path 47 and which serves as a connection portion to the intake manifold 8. A reference sign 21S in FIG. 3 shows the size of the opening of the intake port 21. Thus, it is possible to reduce the intake resistance in the engine 1 and to improve the fuel consumption of the engine 1.

Also, according to the cylinder head 3 and the engine 1 of the present embodiment, the intake manifold 8 is integrally formed with the cylinder head main body 6. Therefore, the connecting flow path 47 can be formed in the vicinity of a boundary region between the cylinder head main body 6 and the intake manifold 8 in of the inside portion of the cylinder head main body 6.

Also, even if the connecting flow path 47 is formed across the inside portion of the cylinder head main body 6 and the inside portion of the intake manifold 8, it is possible to smoothly flow the fuel in the connecting flow path 47. For example, in the configuration in which the intake manifold 8 and the cylinder head main body 6 are separately formed and fixed to each other, when the connection flow path 47 is formed across the inside of the cylinder head main body 6 and the inside of the intake manifold 8, as a result of the displacement of the connecting portion between the cylinder head main body 6 and the intake manifold 8, the connection portion becomes the resistance of the flow in the connecting flow path 47. Therefore, it is difficult to smoothly flow the fuel in the connecting flow path 47.

Further, according to the cylinder head 3 and the engine 1 of the present embodiment, a plurality of rocker shafts 51 are constituted by being provided separately from each other. Therefore, even if the bolt holes 60 are formed in the area between the two adjacent rocker shafts 51 on the upper surface 6*a* of the cylinder head main body 6, the bolt hole 60 and the fixing bolt inserted therethrough are prevented from being covered by the rocker shaft 51. Thus, the cylinder head 3 can be attached and detached to and from the cylinder block 2 while the rocker shaft 51 is attached to the cylinder head 3. In other words, it is possible to easily attach and detach the cylinder head 3 to and from the cylinder block 2.

<Other Embodiments>

Although an embodiment of the present invention has been described as above, the present invention is not limited thereto and can be appropriately changed without departing from the technical idea of the present invention.

In the cylinder head of the present invention, the number of rocker shafts may be, for example, one. In other words, all rocker arms may be mounted on the same rocker shaft.

In the cylinder head of the present invention, the fluid flowing through the flow path may be, for example, a cooling water for cooling the cylinder head main body. The flow path through which the cooling water flows may be, for example, a flow path that leads the cooling water from a cooling water flowing space formed in an inside portion of the cylinder head main body to an auxiliary device (e.g., a hydraulic pump). The cooling water guided to the auxiliary device may, for example, cool the auxiliary device.

The number of cylinders in the engine of the present invention may be, for example, one.

The engine of the present invention may be applied to any work vehicle such as a dump truck, a hydraulic excavator, a bulldozer, an engine type forklift, or the like.

EXPLANATION OF REFERENCE SIGN

1: Engine,
2: Cylinder block,
3: Cylinder head,
6: Cylinder head main body,
17
7: Rocker housing,
8: Intake manifold,
11: Cylinder,
21: Intake port,
22: Exhaust port,
25: Fuel injector,
27: Fuel tank,
29: Common rail,
40: Valve-system accommodating space,
41: Lateral wall,
41A: Intake-side lateral wall,
41B: Exhaust-side lateral wall,
42: End wall,
44: Lateral wall main body,
45: Base end portion,
46: Flow path,
46A: Fuel return flow path,
46B: Lubrication oil flow path,
47: Connecting flow path,

48: Supply flow path,
60: Bolt hole

The invention claimed is:

1. A cylinder head comprising:

a cylinder head main body having an intake port on an intake side of the cylinder head main body, communicating with a cylinder of a cylinder block and an exhaust port communicating with the cylinder;

a rocker housing integrally formed on the cylinder head main body and an inner side of which is a valve-system accommodating space, and an intake manifold integrally formed on the intake side of the cylinder head main body and connected to the intake port, wherein the rocker housing includes a lateral wall having a lateral wall main body and a base end portion that extends along a lower end of the lateral wall main body, connects the lateral wall main body to the cylinder head main body, and has a thickness thicker than that of the lateral wall main body, wherein a flow path extending in an extending direction of the base end portion and through which a fluid flows is formed in the base end portion, wherein a plurality of the cylinders arranged in the cylinder block, the intake port and the exhaust port communicate with each of the cylinders, and the lateral wall and the flow path extend in a cylinder arranged direction that is an arrangement direction of the cylinders, wherein each intake port is formed so as to intake air from an intake side which is one side of an orthogonal direction orthogonal to the cylinder arranged direction, wherein the rocker housing has an intake-side lateral wall disposed on the intake side as the lateral wall, wherein as the flow path, a fuel return flow path through which a fuel flows is formed in the base end portion of the intake-side lateral wall, wherein the fuel has returned from a plurality of fuel injectors that are arranged so as to inject fuel into each cylinders, wherein the intake manifold extends in the cylinder arranged direction so as to be connected to each intake port, wherein a connecting flow path extending from each fuel injector to the fuel return flow path is formed in the cylinder head main body, wherein the fuel return flow path is located above the internal space of the intake manifold, and the connecting flow path extends while inclining upward from each fuel injector toward the intake side so as to pass between the valve-system accommodating space and an internal space of the intake port and the intake manifold communicating with the intake port.

2. The cylinder head according to claim 1, wherein the fluid is a fuel or a lubricating oil.

3. The cylinder head according to claim 1, wherein each exhaust port is formed so as to be exhausted to an exhaust side, which is the other side of the orthogonal direction orthogonal to the cylinder arranged direction, wherein the rocker housing has an exhaust-side lateral wall disposed on the exhaust side as the lateral wall, and wherein as the flow path, a lubricating oil flow path through which a lubricating oil supplied to the valve-system component flows is formed in a base end portion of the exhaust-side lateral wall.

* * * * *